US010135165B2

(12) United States Patent
Zuo

(10) Patent No.: US 10,135,165 B2
(45) Date of Patent: Nov. 20, 2018

(54) CONTACT STRUCTURE FOR HIGH RELIABILITY ELECTRICAL CONNECTOR

(71) Applicant: Amphenol FCI Asia Pte Ltd, Singapore (SG)

(72) Inventor: Nickor Zuo, Dongguan (CN)

(73) Assignee: Amphenol FCI Asia Pte Ltd, Singapore (SG)

( * ) Notice: Subject to any disclaimer, the term of this patent is extended or adjusted under 35 U.S.C. 154(b) by 0 days.

(21) Appl. No.: 15/481,344

(22) Filed: Apr. 6, 2017

(65) Prior Publication Data

US 2017/0294728 A1 Oct. 12, 2017

(30) Foreign Application Priority Data

Apr. 6, 2016 (CN) ..... 2016 2 0277014 U

(51) Int. Cl.
*H01R 12/72* (2011.01)
*H01R 13/26* (2006.01)

(52) U.S. Cl.
CPC ..... *H01R 12/721* (2013.01); *H01R 13/26* (2013.01)

(58) Field of Classification Search
CPC ..... H01R 23/7068; H01R 23/725
USPC ..... 439/637
See application file for complete search history.

(56) References Cited

U.S. PATENT DOCUMENTS 3,543,226 A * 11/1970 Laboue ..... H01R 12/721 439/637
3,631,381 A * 12/1971 Pittman ..... H01R 12/721 439/637
4,002,400 A 1/1977 Evans
4,087,151 A * 5/1978 Robert ..... H01R 23/70 200/51.1
4,106,841 A * 8/1978 Vladic ..... H01R 23/70 439/188
4,514,030 A * 4/1985 Triner ..... H01R 12/721 439/188
5,082,459 A 1/1992 Billman et al.
5,239,748 A * 8/1993 Hamilton ..... H05K 1/117 29/843
5,263,870 A * 11/1993 Billman ..... H01R 23/688 439/108
5,462,456 A 10/1995 Howell
(Continued)

*Primary Examiner* — Gary Paumen
(74) *Attorney, Agent, or Firm* — Wolf, Greenfield & Sacks, P.C.

(57) ABSTRACT

This application relates to electrical connectors. An electrical connector, according to some embodiments, comprises a housing, a slot formed in the housing, the slot comprising an entrance, and first and second rows of conductive elements arranged in the housing. Each conductive element comprises a mounting end, a mating end opposite the mounting end, and an intermediate portion that extends between the mounting end and the mating end. The mating end comprises first and second contact portions projecting into the slot, and the first contact portion is closer to the entrance than the second contact portion. The first and second contact portions are capable of flexing along a width direction of the slot between a first position and a second position, the second contact portions form a receiving space between the first and second rows of conductive element, and the receiving space is smaller at the first position than the second position.

20 Claims, 6 Drawing Sheets

(56) References Cited

U.S. PATENT DOCUMENTS

| | | | | |
|---|---|---|---|---|
| 5,865,649 | A * | 2/1999 | Yu | H01R 12/7005 439/637 |
| 6,764,345 | B1 * | 7/2004 | Duesterhoeft | H01R 12/721 439/637 |
| 7,628,654 | B2 * | 12/2009 | Hori | H01R 13/5205 439/637 |
| 7,637,783 | B2 * | 12/2009 | Sasaoka | H01R 43/16 439/637 |
| 8,147,265 | B2 | 4/2012 | Chiu | |
| 8,550,861 | B2 | 10/2013 | Cohen et al. | |
| 8,727,791 | B2 | 5/2014 | Gulla | |
| 9,017,114 | B2 | 4/2015 | Cohen et al. | |
| 9,022,811 | B2 * | 5/2015 | Takaki | H01R 12/70 439/637 |
| 9,033,750 | B2 | 5/2015 | Miller et al. | |
| 9,190,745 | B2 | 11/2015 | Gulla | |
| 2009/0191764 | A1 * | 7/2009 | Hori | H01R 12/79 439/637 |
| 2011/0021080 | A1 * | 1/2011 | Kamiya | H01R 12/778 439/637 |

* cited by examiner

CONTACT STRUCTURE FOR HIGH RELIABILITY ELECTRICAL CONNECTOR

RELATED APPLICATIONS

This application claims priority to and the benefit of Chinese Patent Application No. 201620277014.2, filed Apr. 6, 2016 and entitled "THE ELECTRICAL CONNECTOR," which application is hereby incorporated herein by reference in its entirety to the maximum extent allowably by law.

FIELD OF THE INVENTION

The present invention relates to an electrical connector, and more particularly to a card edge connector.

BACKGROUND

Electrical connectors are used in many electronic systems, including telecommunication, storage technology, data transmission, etc. Card edge connectors are widely used to make connections between a backplane and several daughtercards such that signals may be routed between the backplane and the daughtercards.

Card edge connectors may be mounted on a backplane. Conducting traces in the backplane may be electrically connected to conductive elements in the connectors. Daughtercards have conductive pads at edges, sometimes called contact fingers, which may be electrically connected to conductive elements of card edge connectors when inserted in slots of the card edge connectors. Signals may be routed among daughtercards through the connectors and the backplane.

Conductive pads of daughtercards are susceptible to oxidation, scratches, and/or contaminations, which may deteriorate their connections with conductive elements of card edge connectors and thus their connections with the backplane.

BRIEF SUMMARY

This application relates to electrical connectors. An electrical connector, according to some embodiments, comprises a housing, a slot formed in the housing, the slot comprising an entrance, and first and second rows of conductive elements arranged in the housing. Each conductive element comprises a mounting end, a mating end opposite the mounting end, and an intermediate portion that extends between the mounting end and the mating end. The mating end comprises first and second contact portions projecting into the slot, and the first contact portion is closer to the entrance than the second contact portion. The first and second contact portions are capable of flexing along a width direction of the slot between a first position and a second position, the second contact portions form a receiving space between the first and second rows of conductive element, and the receiving space is smaller at the first position than the second position.

The first and second contact portions may be aligned along a height direction of the slot. The first contact portion may be shaped as a hook. A proximal end of the hook may be closer to the entrance than a distal end of the hook. The second contact portion may be a curve. The apex of the curve may be closer to the slot.

BRIEF DESCRIPTION OF DRAWINGS

Embodiments of the present application will be explained in detail with respect to the drawings. In the drawings.

In the drawings, for purposes of clarity, embodiments may be simplified. Each identical or nearly identical component that is illustrated in various figures is represented by a like numeral.

DETAILED DESCRIPTION

Embodiments of the present application will be described below in detail with respect to the drawings.

Figure 1:
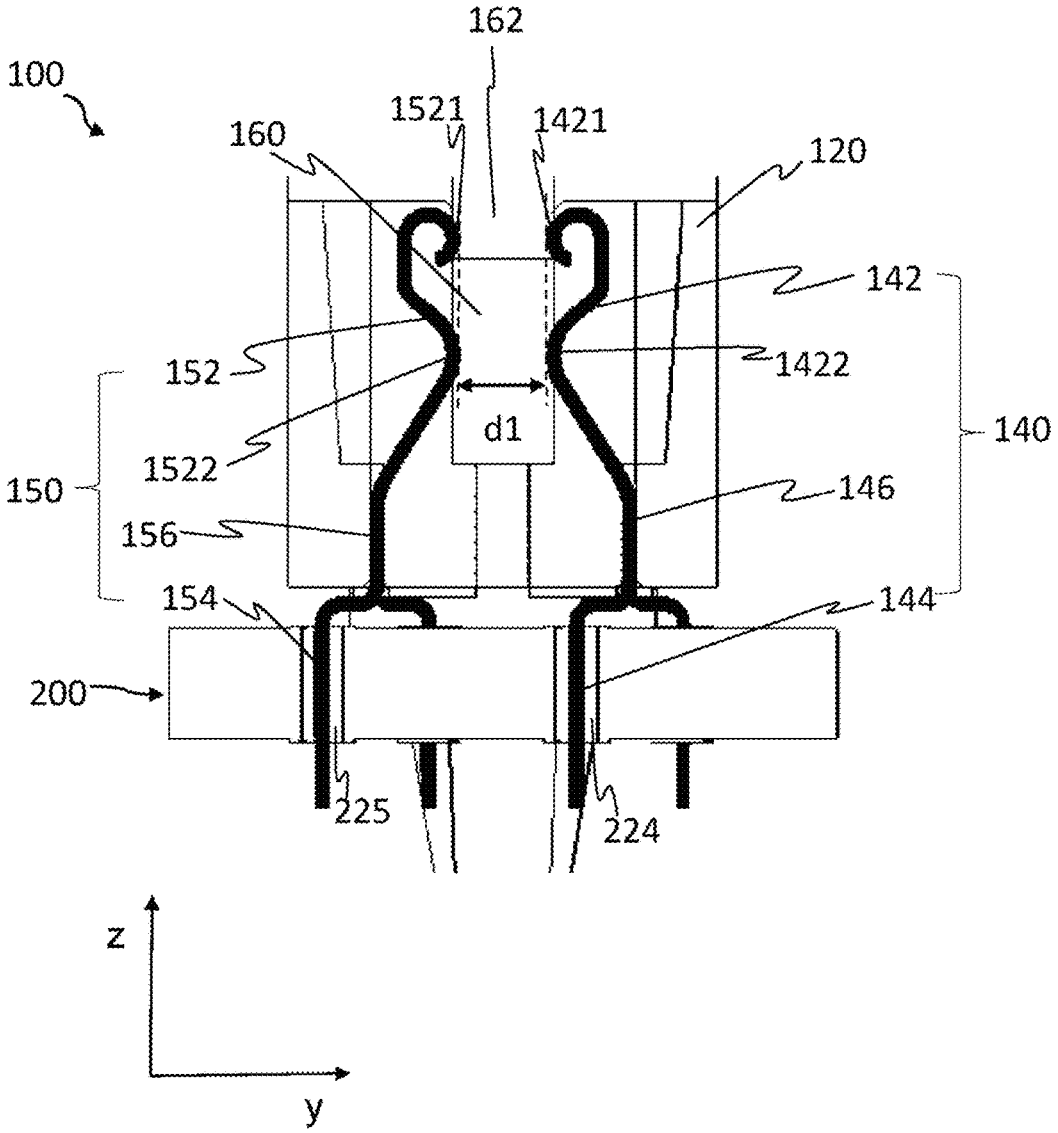
FIG. 1 shows a cross-sectional view of an electrical connector mounted to a printed circuit board, according to some embodiments.

FIG. 1 shows a cross-sectional view of an electrical connector 100 mounted to a printed circuit board 200, according to some embodiments. To simplify the description, a direction parallel to a height of the electrical connector 100 is defined as z direction, and a direction parallel to a width of the electrical connector 100 is defined as y direction. FIG. 1 is a cross-sectional view along the yz plane. The electrical connector 100 may include housing 120, conductive elements 140 and 150 arranged in the housing, and slot 160 formed in the housing. Slot 160 may receive a printed circuit board that is to be connected to the printed circuit board 200. Slot 160 may include an entrance 162.

In the illustrated embodiment, electrical connector 100 includes two rows of conductive elements 140, 150, arranged at two opposing sides of the slot 160 along a width direction (i.e. y direction as illustrated in FIG. 1). Conductive element 140 includes a mating end 142, a mounting end 144, and an intermediate portion 146 that extends between the mounting end and the mating end. As illustrated in FIG. 1, the mounting end 144 of the conductive element 140 may be press fitted into holes 224 of the printed circuit board 200. The mating end 142 of the conductive element 140 includes a first contact portion 1421 and a second contact portion 1422, both of which project into the lot. The first contact portion 1421 is closer to the entrance 162 of the slot than the second contact portion 1422. The mating end 142 of the conductive element 140 may flex along the width direction and away from the conductive element 150.

Similarly, conductive element 150 includes a mating end 152, a mounting end 154, and an intermediate portion 156 that extends between the mounting end and the mating end. The mounting end 154 of the conductive element 150 may be press fitted into holes 225 of the printed circuit board 200. The mating end 152 of the conductive element 150 includes a first contact portion 1521 and a second contact portion 1522, both of which project into the lot. The first contact portion 1521 is closer to the entrance 162 of the slot than the second contact portion 1522. The mating end 152 of the conductive element 150 may flex along the width direction and away from the conductive element 140. The rest states of the conductive elements 140 and 150 shown in FIG. 1 are defined as a first position, i.e. an initial position. The distance between conductive element 140 and conductive element 150 is named as a receiving space, illustrated as d1 in FIG. 1.

In the illustrated embodiment, the mating end 142 and the intermediate portion 146 of the conductive element 140 and the mating end 152 and the intermediate portion 156 of the conductive element 150 symmetrically locate at the two sides of the slot 160. In some embodiments, conductive elements 140 and 150 may be asymmetrical. The implementation of this invention is not limited by their symmetry.

In the illustrated embodiment, electrical connector 100 includes two rows of conductive elements 140, 150. In some embodiments, an electrical connector may have one row of conductive elements 140. Correspondingly, the rest state of conductive elements 140 may be defined as the first position. The receiving space is the distance between conductive element 140 and an interior of a wall, which is spaced from the conductive element 140, of the slot.

Figure 2:
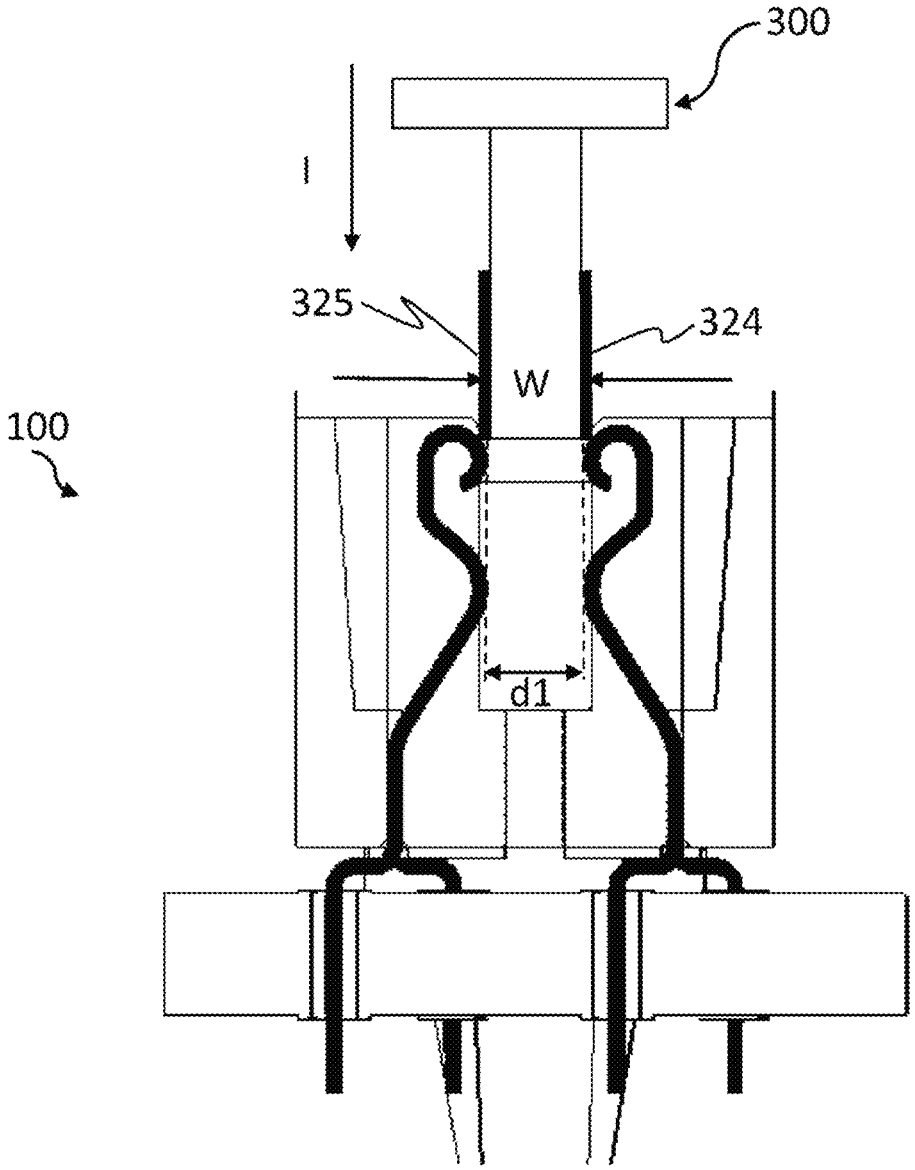
FIG. 2 to FIG. 4 show cross-sectional views illustrating the process of inserting a printed circuit board into an electrical connector, according to some embodiments.
Figure 3:
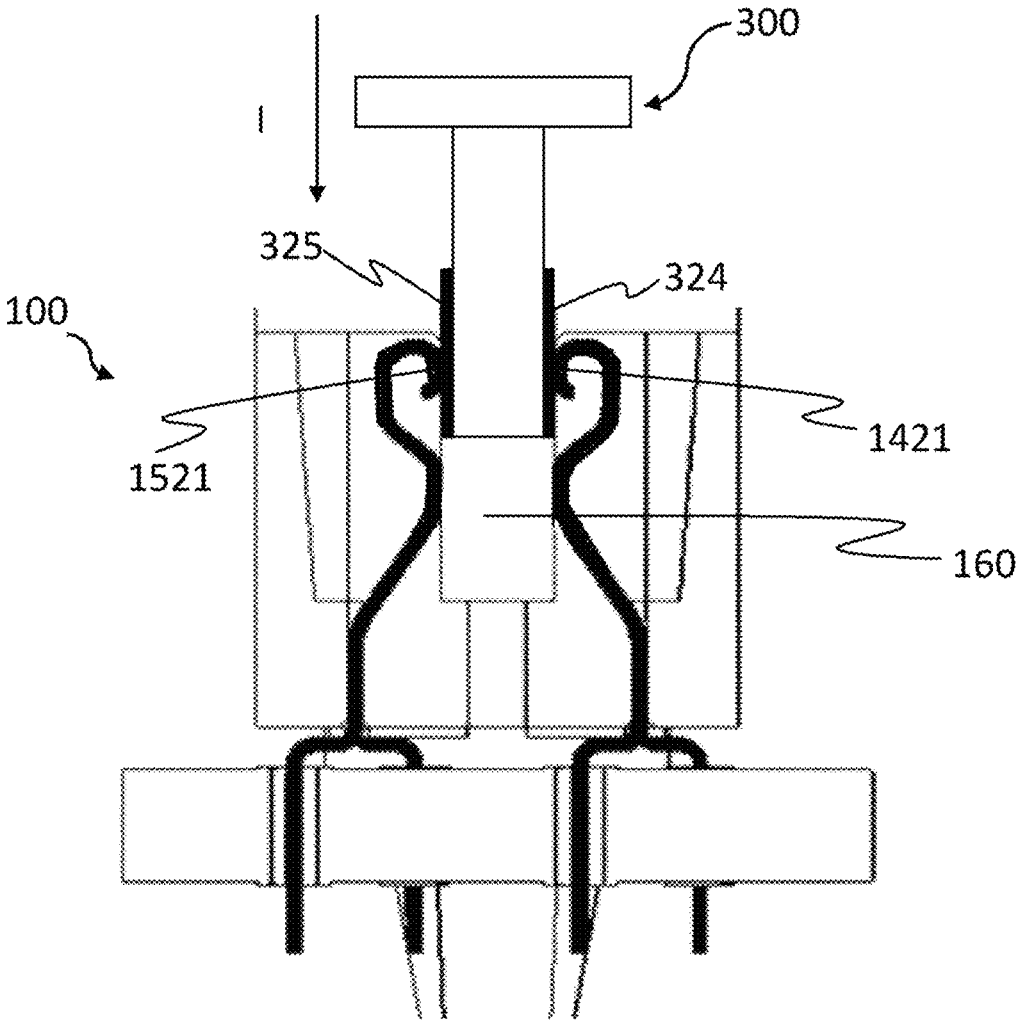
Figure 4:
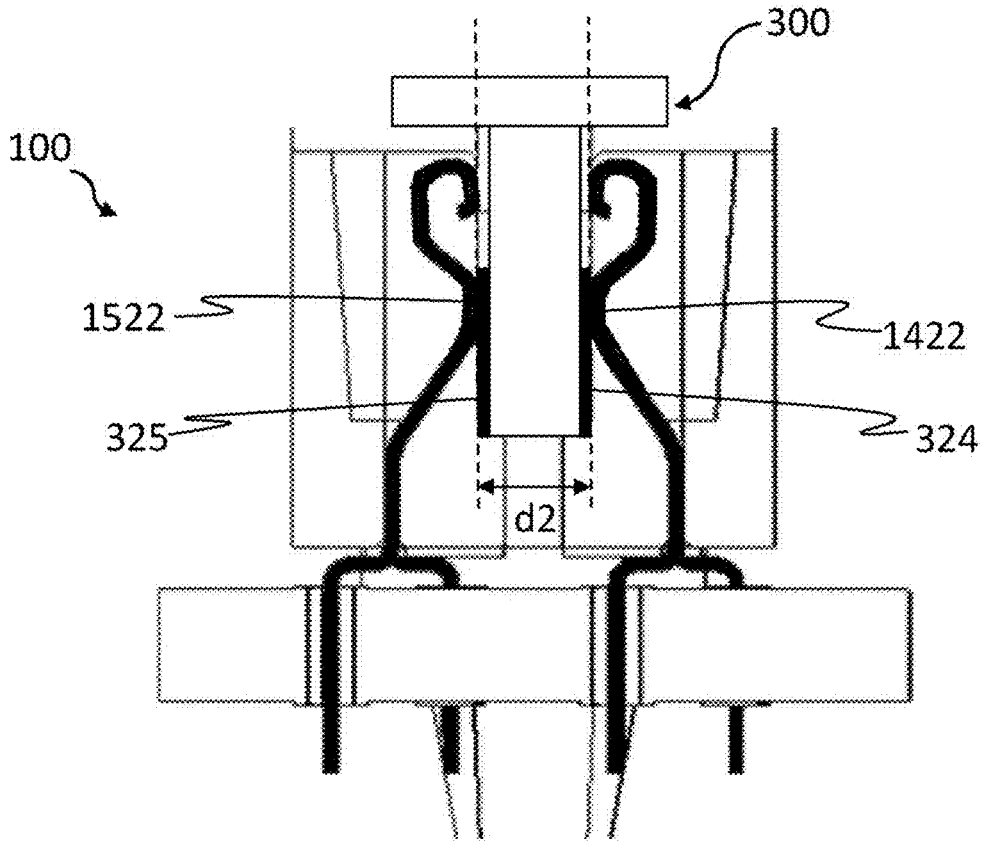

FIG. 2 to FIG. 4 show cross-sectional views illustrating the process of inserting printed circuit board 300 into electrical connector 100. Printed circuit board 300 may include conductive pads 324 and 325 at edges of two opposing surfaces respectively. Printed circuit board 300 may be inserted into electrical connector 100 from the entrance 162 of the slot 160 along a height direction (illustrated as I), i.e. the opposite direction of z direction. Printed circuit board 300 has a thickness W, which is larger than the receiving space d1. Therefore, conductive elements 140 and 150 may flex away from each other under a force generated by the printed circuit board 300.

Conductive pad 324 of printed circuit board 300 may first engage the first contact portion 1421 of the mating end 142 of the conductive element 140. At the same time, conductive pad 325 may engage the first contact portion 1521 of the mating end 152 of the conductive element 150. During the process of moving the printed circuit board 300 to a bottom of the slot 160, surfaces of conductive pads 324 and 325 slide across the first contact portions 1421 of the conductive elements 140 and the first contact portions 1521 of the conductive elements 150 respectively. It should be appreciated that, under elastic forces, the mating end 142 of the conductive element 140 and the mating end 152 of the conductive element 150 may press the surfaces of the conductive pads 324 and 325. At the same time, when the first contact portions 1421 and 1521 slide across the surfaces of the conductive pads 324 and 325, external attachments to conductive pads 324 and 325 may be removed.

As continuing moving the printed circuit board 300 to the bottom of the slot 160, the surface of the conductive pad 324, which has been scribed by the mating end 142 of the conductive element 140, may engage the second contact portion 1422 of the conductive element 140. Similarly, the surface of the conductive pad 325, which has been scribed by the mating end 152 of the conductive element 150, may engage the second contact portion 1522 of the conductive element 150. At this point, the conductive pads 324 and 325 may have cleaner surfaces in order to form reliable electrical connections with the electrical connector, which is advantageous to signal transmissions between printed circuit board 200 and printed circuit board 300. The states of the conductive elements 140 and 150 at this point are defined as a second position. The receiving space at the second position is illustrated as d2 in FIG. 4. The receiving space d1 at the first position may be smaller than the receiving space d2 at the second position. It should be appreciated that the receiving space d2 may be the thickness W of the printed circuit board 300.

In the illustrated embodiment, the first contact portions and the second contact portions of conductive elements are aligned along the height direction, i.e. z direction. Correspondingly, a surface of a conductive pad of the printed circuit board 300, which engages a second contact portion of a conductive element, has been cleaned by a first contact portion of the conductive element. The conductive elements having two contact portions provide the function of removing external attachments on conductive pads of daughtercards, and thus reliable connections between the daughtercards and the electrical connector. It optimizes signal transmissions between the daughtercards and a backplane to which the connectors mounted.

In the illustrated embodiment, the first contact portions 1421 and 1521 are shaped as a hook. A proximal end of the hook is closer to the slot 160 than a distal end of the hook. When the printed circuit board 300 engages the first contact portions 1421 and 1521, the proximal end of the hook provides a sloped surface guiding the insertion of the printed circuit board 300, which makes the insertion smoother. The second contact portions 1422 and 1522 may be shaped as a curve. The apex of the curve is closer to the slot 160.

Figure 5:
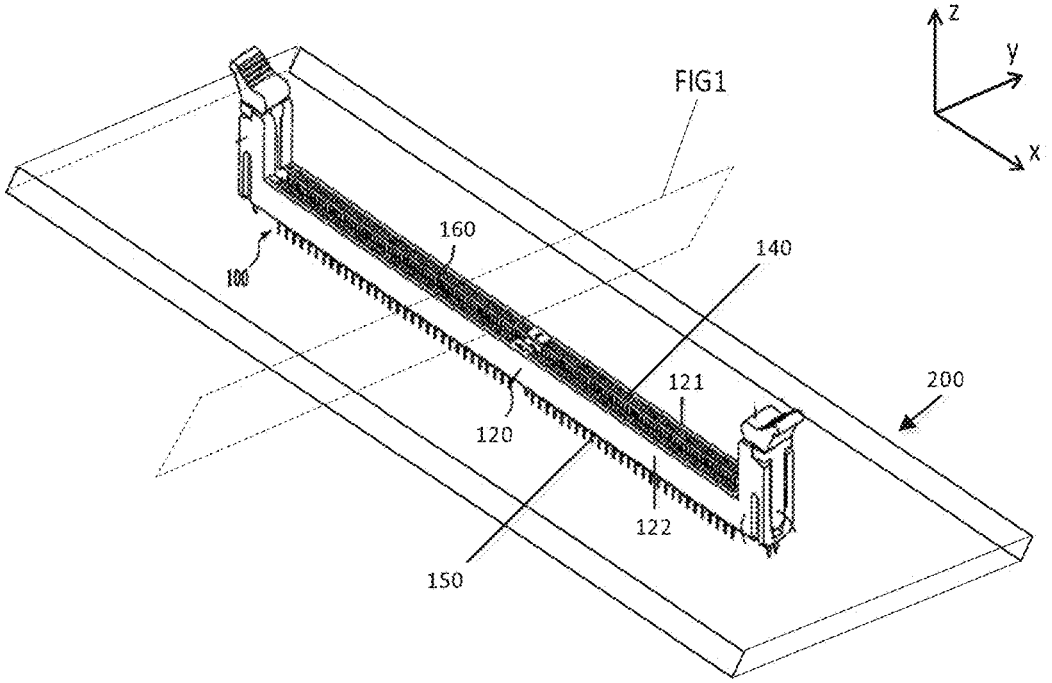
FIG. 5 is a perspective view of an electrical assembly comprising a printed circuit board, to which an electrical connector is mounted, according to some embodiments.

FIG. 5 shows a perspective view of an electrical assembly comprising a printed circuit board 200, to which an electrical connector 100 is mounted, according to some embodiments. FIG. 1 may be a cross-sectional view of the electrical assembly across the marked plane FIG. 1 (i.e. a yz plane). The electrical connector 100 may include a housing 120, and a plurality of conductive elements 140 and 150 held by the housing. The housing 120 may include a slot 160, into which another printed circuit board may be inserted. The conductive elements 140 and 150 may be arranged into two rows at two opposing sides 121 and 122 of the slot 160 respectively.

Figure 6A:
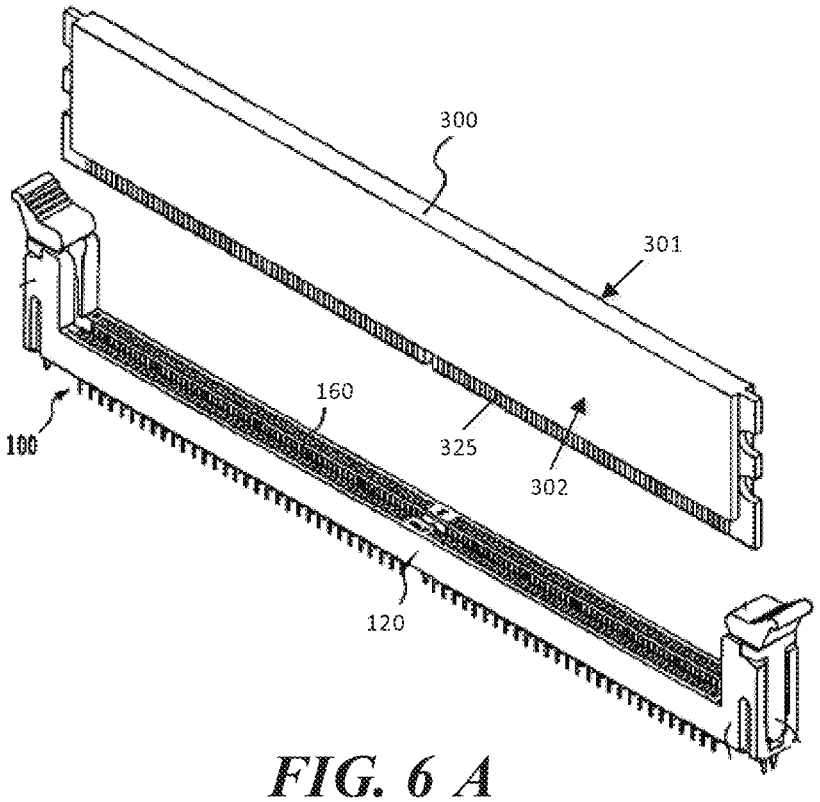
FIG. 6A is a perspective view of an electrical connector before being combined with a printed circuit board.
Figure 6B:
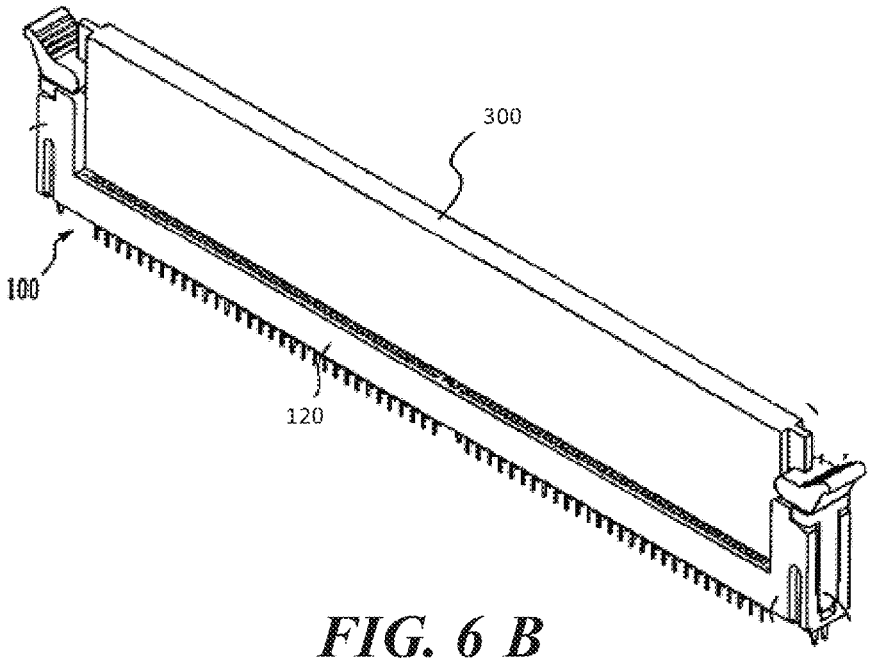
FIG. 6B is a perspective view of the electrical connector in FIG. 6A after being combined with the printed circuit board in FIG. 6A.

FIGS. 6A and 6B illustrates perspective views of a printed circuit board 300 before and after being inserted into the slot 160 of the electrical connector 100, according to some embodiments. The printed circuit board may include two opposing insulative surfaces 301 and 302, at respective edges of which conductive pads 324 (not shown) and 325 may be provided. In some embodiments, the printed circuit board 300 may be a memory module. In some embodiments, the electrical connector 100 may be a DDR DIMM socket.

Although aspects of embodiments of this invention have been described with respect to the drawings, it should be appreciated that this invention is not limited by the described embodiments. It should be appreciated that various alterations, modifications, and improvements will readily occur to those skilled in the art. Such alterations, modifications, and improvements are intended to be part of this disclosure, and are intended to be within the spirit and scope of the invention.

What is claimed is:

1. An electrical connector, comprising:

a housing comprising a slot having an entrance; and first and second conductive elements held by the housing on opposite sides of the slot, each conductive element comprising a mounting end, a mating end opposite the mounting end, and an intermediate portion that extends between the mounting end and the mating end, wherein:

the mating end comprises a single beam comprising first and second contact portions projecting into the slot such that the mating end is capable of flexing, the first contact portion being closer to the entrance than the second contact portion, the first contact portion is shaped as a hook and comprises a proximal end and a distal end, the proximal end being closer to the entrance than the distal end, and the first contact portion of the first conductive element is spaced from the first contact portion of the second conductive element by a distance such that the first conductive element is electrically insulated from the second conductive element.

2. The electrical connector as recited in claim 1, wherein the slot is configured to receive a card.

3. The electrical connector as recited in claim 2, wherein the card is a memory module.

4. The electrical connector as recited in claim 1, wherein the second contact portion curves inwardly into the slot.

5. The electrical connector as recited in claim 1, wherein:

the first conductive element and the second conductive element locate on opposite sides of the slot such that the mating ends of the first and second conductive elements are capable of flexing away from each other.

6. The electrical connector as recited in claim 2, wherein:

the distance is smaller than a thickness of the card.

7. The electrical connector as recited in claim 1, further comprising:

a first plurality of conductive elements arranged in a first row with the first conductive element; and a second plurality of conductive elements arranged in a second row with the second conductive element.

8. An electrical assembly, comprising:

a card comprising a first insulative surface having a conductive pad thereon; and an electrical connector, comprising a housing comprising a slot having an entrance, and a first conductive element held by the housing, the first conductive element comprising a mounting end, a mating end opposite the mounting end, and an intermediate portion that extends between the mounting end and the mating end, wherein the mating end comprises a first contact portion and a second contact portion, the first contact portion being closer to the entrance than the second contact portion; wherein:

the first contact portion of the first conductive element engages the first insulative surface and the second contact portion of the first conductive element engages the conductive pad on the first insulative surface.

9. The electrical assembly as recited in claim 8, wherein:

the card further comprises a second insulative surface having a conductive pad thereon;

the electrical connector further comprises a second conductive element held by the housing, the second conductive element comprising a mounting end, a mating end opposite the mounting end, and an intermediate portion that extends between the mounting end and the mating end, wherein the mating end comprises a first contact portion and a second contact portion, the first contact portion being closer to the entrance than the second contact portion; and the second contact portion of the second conductive element engages the second insulative surface and the second contact portion of the second conductive element engages the conductive pad on the second insulative surface.

10. The electrical assembly as recited in claim 8, wherein:

the card further comprises a plurality of conductive pads on the first insulative surface;

the electrical connector further comprises a plurality of first conductive elements arranged in a row;

the first contact portions of the plurality of first conductive elements engage the first insulative surface; and the second contact portions of the plurality of first conductive elements engage the plurality of conductive pads on the first insulative surface.

11. The electrical assembly as recited in claim 9, wherein:

the card further comprises a plurality of conductive pads on the first insulative surface and a plurality of conductive pads on the second insulative surface;

the electrical connector further comprises a plurality of first conductive elements arranged in a first row and a plurality of second conductive elements arranged in a second row;

the first contact portions of the plurality of first conductive elements engage the first insulative surface and the second contact portions of the plurality of first conductive elements engage the plurality of conductive pads on the first insulative surface; and the first contact portions of the plurality of second conductive elements engage the second insulative surface and the second contact portions of the plurality of second conductive elements engage the plurality of conductive pads on the second insulative surface.

12. The electrical assembly as recited in claim 8, wherein the first contact portion of the first conductive element is shaped as a hook, and comprises a proximal end and a distal end, the proximal end being closer to the entrance than the distal end.

13. The electrical assembly as recited in claim 8, wherein the second contact portion of the first conductive element curves inwardly towards the conductive pad on the first insulative surface.

14. A method of operating an electrical connector comprising a housing comprising a slot having an entrance, and a first conductive element held by the housing, the first conductive element comprising a mounting end, a mating end opposite the mounting end, and an intermediate portion that extends between the mounting end and the mating end, wherein the mating end comprises a first contact portion and a second contact portion, the first contact portion being closer to the entrance than the second contact portion, the method comprising:

inserting a card into the slot, wherein the card comprises a first insulative surface having a conductive pad thereon;

pressing the mating end of the first conductive element such that the mating end of the first conductive element flexes away from the slot under a force generated by the card; and moving the card in the slot toward a direction opposite the entrance such that the first contact portion of the first conductive element engages the conductive pad on the first insulative surface of the card and then disengages the conductive pad on the first insulative surface of the card, and the second contact portion of the first conductive element engages the conductive pad on the first insulative surface of the card such that a reliable electrical connection is established between the first conductive element and the conductive pad.

15. The method as recited in claim 14, wherein the moving step comprises removing a portion from the conductive pad.

16. The method as recited in claim 14, wherein the moving step comprises scribing a surface of the conductive pad.

17. The method as recited in claim 14, wherein:

the card further comprises a second insulative surface having a conductive pad thereon;

the electrical connector further comprises a second conductive element held by the housing, the second conductive element comprising a mounting end, a mating end opposite the mounting end, the mating end comprising a first contact portion and a second contact portion, the first contact portion being closer to the entrance than the second contact portion, and an intermediate portion that extends between the mounting end and the mating end, wherein the first conductive element and the second conductive element are located on opposite sides of the slot;

the pressing step comprises pressing the mating end of the second conductive element such that the mating end of the second conductive element flexes away from the slot under a force generated by the card;

the moving step results that the first contact portion of the second conductive element engages the conductive pad on the second insulative surface of the card and then disengages the conductive pad on the second insulative surface of the card, and the second contact portion of the second conductive element engages the conductive pad on the second insulative surface of the card such that a reliable electrical connection is established between the second conductive element and the conductive pad on the second insulative surface of the card.

18. The method as recited in claim 14, wherein the first contact portion of the first conductive element is shaped as a hook and comprises a proximal end and a distal end, the proximal end being closer to the entrance than the distal end, the proximal end comprising a sloped surface configured to guide the card into the slot.

19. The method as recited in claim 17, wherein the first and second conductive elements space from each other by a first distance before inserting the card, and by a second distance after the second contact portions of the first and second conductive elements engaging the conductive pads on the first and second insulative surface of the card, the second distance being larger than the first distance.

20. The method as recited in claim 19, wherein the second distance substantially equals to a thickness of the card.

* * * * *